US006644192B2

(12) United States Patent
Dilling et al.

(10) Patent No.: US 6,644,192 B2
(45) Date of Patent: Nov. 11, 2003

(54) ROTARY PRINTING MACHINE, HAVING SAFETY ORIENTED ACCESS MODULES

(75) Inventors: Peer Dilling, Friedberg (DE); Hermann Lenz, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 328 days.

(21) Appl. No.: 09/791,299

(22) Filed: Feb. 23, 2001

(65) Prior Publication Data

US 2001/0017088 A1 Aug. 30, 2001

(30) Foreign Application Priority Data

Feb. 23, 2000 (DE) ..... 100 08 221

(51) Int. Cl.[7] ..... B41F 33/00
(52) U.S. Cl. ..... 101/480; 101/DIG. 35
(58) Field of Search ..... 101/DIG. 35, 480

(56) References Cited

U.S. PATENT DOCUMENTS

| | | | | | |
|---|---|---|---|---|---|
| 3,788,218 | A | * | 1/1974 | Fusco et al. | 101/180 |
| 5,129,321 | A | * | 7/1992 | Fadner | 101/467 |
| 5,178,069 | A | * | 1/1993 | Rodi | 101/480 |
| 5,287,007 | A | * | 2/1994 | Rodi et al. | 307/38 |
| 5,528,985 | A | | 6/1996 | Haller | 101/216 |
| 5,657,529 | A | * | 8/1997 | Bohn et al. | 29/563 |
| 5,699,734 | A | * | 12/1997 | Bitterich | 101/216 |
| 5,782,183 | A | | 7/1998 | Andrews, Jr. | 101/232 |
| 5,865,119 | A | * | 2/1999 | Michalik | 101/480 |
| 6,038,973 | A | * | 3/2000 | Marmin | 101/225 |
| 6,085,650 | A | | 7/2000 | Peterson | |

FOREIGN PATENT DOCUMENTS

| | | |
|---|---|---|
| DE | 34 23 272 | 1/1986 |
| DE | 253 007 | 1/1988 |
| DE | 43 37 554 | 12/1992 |
| DE | 297 10 189 | 10/1997 |
| DE | 199 54 458 | 5/2001 |
| GB | 1454542 | * 11/1976 |
| GB | 2 203 696 | 10/1988 |
| GB | 2 304 632 | 3/1997 |
| WO | WO 97/35145 | 9/1997 |

* cited by examiner

*Primary Examiner*—Daniel J. Colilla
*Assistant Examiner*—Jill E Culler
(74) *Attorney, Agent, or Firm*—Cohen, Pontani, Lieberman & Pavane

(57) ABSTRACT

In a web-fed rotary offset printing machine, operating preferably with variable-format cylinders, both sides of the printing machine are covered, during the operation and resetting of the machine, so that no access, in particular no access to the printing units, is possible. For this purpose, an access module is used between the printing-units, which module is equipped laterally with covers which resemble window roller blinds and cannot be opened while the machine is in operation.

19 Claims, 4 Drawing Sheets

1
2
3
4
5
6
7
8
9
10
11
12
13
14
15
16
17
18
19
20
21
22
25
55
56
57
59
60
61
62
63

ROTARY PRINTING MACHINE, HAVING SAFETY ORIENTED ACCESS MODULES

BACKGROUND OF THE INVENTION

1. Field of the Invention

The invention relates to a rotary printing machine of the type having a print-carrier supply device, in particular a reel changer; at least one printing unit, in particular a plurality of printing units arranged one behind the other and spaced apart; and a print carrier discharge device, in particular a dryer, a cooling unit, and a cross-cutter with folding means.

2. Description of the Related Art

Rotary printing machines, in particular rotary offset printing machines, conventionally include a print-carrier supply device, for example a reel changer or, if sheet-fed printing machines are concerned, a so-called feeder and also a plurality of printing units arranged one behind the other and at a distance from one another. Web-fed rotary printing machines for high-quality printing, for example illustration printing machines, further include a downstream dryer and a cooling device and also superstructures arranged at the end of the machine, with a folder or stacker or winder or, in the case of sheet-fed printing machines, a delivery. It has been customary from the beginning of printing machine technology, that is to say for about 150 years up to the present day, to produce rotary printing machines in a so-called open design, that is to say there are appropriate possibilities for access and admittance into the interior of the machine, so that certain manipulations, such as setting operations, can be carried out, even while the machine is in operation. The rotary printing machines which have become known hitherto usually have a number of special safety measures which are intended to protect the operating personnel particularly from serious accidents, such as, for example, so-called finger guard spindles or grids for covering specific parts in the printing machine.

SUMMARY OF THE INVENTION

Proceeding from this, the object of the invention is to provide a modern-equipped rotary printing machine, in particular a web-fed rotary offset printing machine, having a high degree of automation, in particular for small to medium print runs, for example of the order of magnitude of up to 50,000 printed copies, with an integral protection system which, during the regular operation of the rotary printing machine, does not allow any ingress into the machine and, furthermore, blocks access into the interior of the machine, so that integral protection of the operating personnel is afforded.

According to the invention, access modules are provided between the at least one printing unit and each of the print carrier supply device and the print carrier discharge device, as well as between the printing units themselves, where more than one printing unit is present. The access modules block access to the interior of the rotary printing machine from either side during printing. Where imaging of printing plates is done in the machine, access to the interior is also blocked during imaging.

According to another aspect of the invention, covers are provided on both sides of a rotary printing machine along its length, which covers cannot be opened during operation.

The general principle of the present invention is to provide a lateral covering of virtually the entire rotary printing machine, including the dryer and the folder, if these are present. A sufficient supply of air for discharge of heat can flow in from the underside of the lateral covers or from the underside of the machine and the heated air can emerge from the topside of the machine. In the concept according to the invention, during normal operation, the printer or operator can no longer have ingress into the mechanics of the machine or carry out regulating actions there. Its possibilities for monitoring during normal printing operation are restricted to the control stand. Other advantages are that, particularly with a view to safety aspects, there is protection for the operating personnel due to increased- laser safety, where laser is used in the machine. The covering also provides sufficient protection for the long linear movements of the printing-unit cylinders of different size for the various formats which can be processed with a high degree of automation by means of the printing machine, without so-called finger guard spindles or special protective grips.

Advantageously, the machine covered according to the invention may be used for short-run printing, for which the machine system is preferably designed, where short resetting times, resetting automation, low spoilage and low machine costs have high priority. In particular, in this case, all resetting operations are executed automatically, so that only minimal human intervention is necessary, that is to say at most only a few direct actions have to be carried out in special instances. Low spoilage values also arise in this context, thus requiring preventive quality control, if possible in the data record, instead of repetitive quality control in the mechanics, as was the case in previous standard machines.

A further advantage is that large-area encapsulation is more cost-effective and is distinguished by comparatively little sensor technology and few individual hazard safeguards, accessibility in a servicing situation being further improved.

From the point of view of the machine attendant/operator, the person hitherto functioning as an integral component of the machine has risen, in the case of the machine in question here, to—an operator or controller with an extended area of responsibility. This is entirely novel for printing machines.

Operation preferably takes place from fixed or portable control stands. No further commands will be available on the outer contour of the machine (in practice, with the exception of "EMERGENCY" and door opener), since direct feedback with functionality to the operator in the form of acoustic or optical signals is not possible through the covers. After the covers are opened, commands relevant to servicing/maintenance may be available behind it, in the form of fixed or portable operating panels. Door opening takes place in a servicing/maintenance situation. Actuation takes place, for example, via an IR sensor. After the sensor is actuated by remote control, the machine must be brought into a safe state (hazardous functions must be stopped). During the period of time of, for example, 5 seconds necessary for this purpose, all the covers or doors remain closed. Visual or acoustic revertive communication acknowledges the command and demands a short wait. The door opening or the opening of the covers may take place completely or in part-regions.

The covers preferably have two-dimensionally curved surfaces in the region of the cover of the printing units. One-dimensionally curved surfaces are highly expedient in the case of the remaining covers. These functions are preferably fulfilled by straightforward door elements in the region of the printing units and by roller blinds in the region where prevention of access is necessary during printing/resetting, but access is necessary in a servicing/adjustment situation. The front-side covers of the printing units and of the access modules is opened motively, preferably by means of electric motors or pneumatic devices. Opening automation takes place with the effect of a rapid reaction in a servicing situation.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figures 1, 1A:
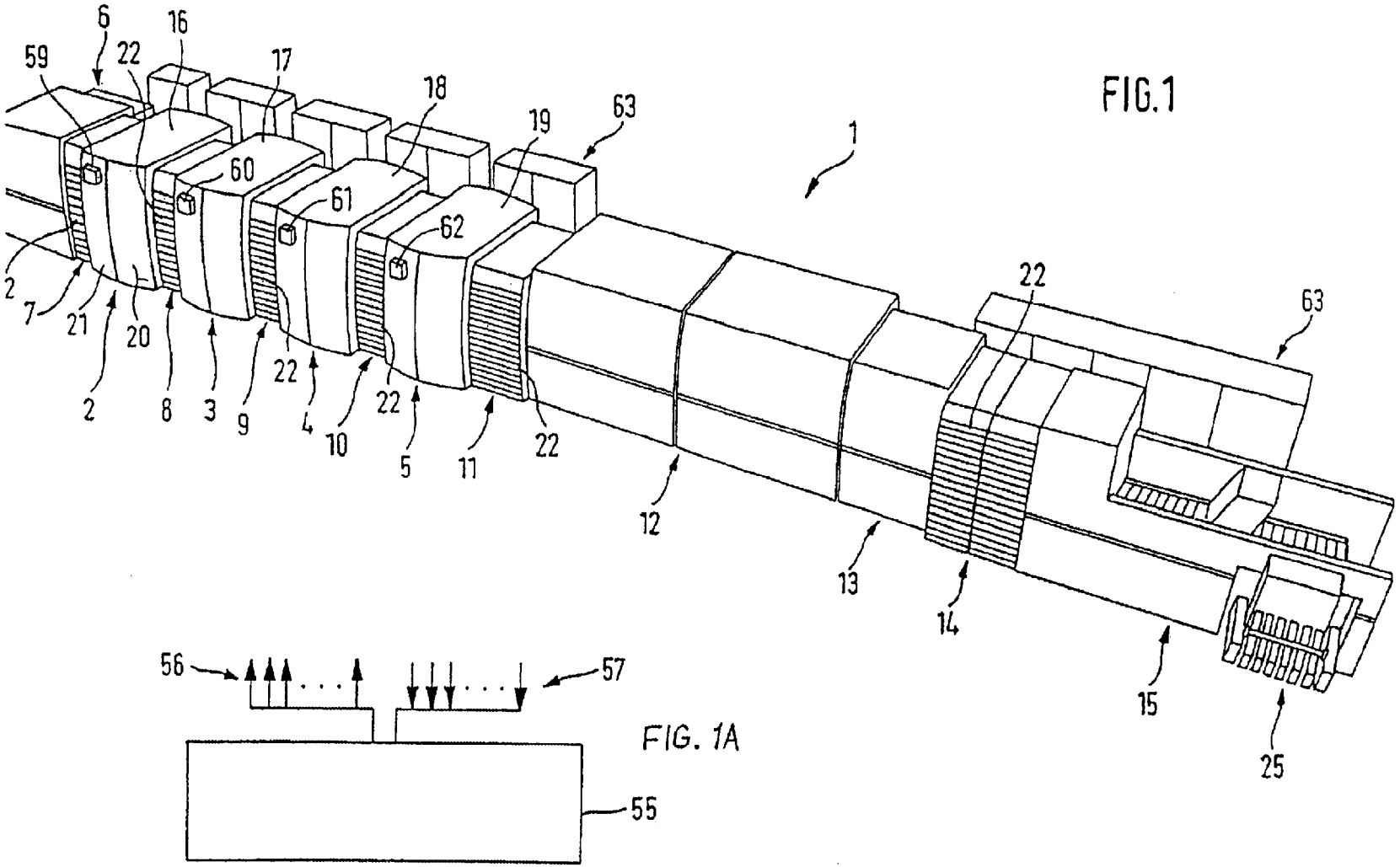
FIG. 1 is a perspective view of the rotary printing machine from the operating side.
FIG. 1*a* is a schematic view of the control desk.

Referring to FIG. 1, a web-fed rotary offset printing machine in which so-called variable-format cylinders, that is cylinders with different diameters, can be used, can be clad on both sides in a particularly advantageous way. However, the present invention is not restricted to this advantageous embodiment of the rotary printing machine. FIG. 1 illustrates four printing units 2, 3, 4, 5 which are arranged one behind the other and are spaced from one another and on the left-hand side of which can be seen a print-carrier supply device in the form of a reel changer 6 which is connected to the first printing unit 2 for a first color via a first access module 7. With the third, fourth, and fifth printing units 3, 4 and 5 three further colors can be applied to the underside and to the topside of a print-carrier web 53 (FIG. 3) guided horizontally through the printing machine 1.

Figure 2:
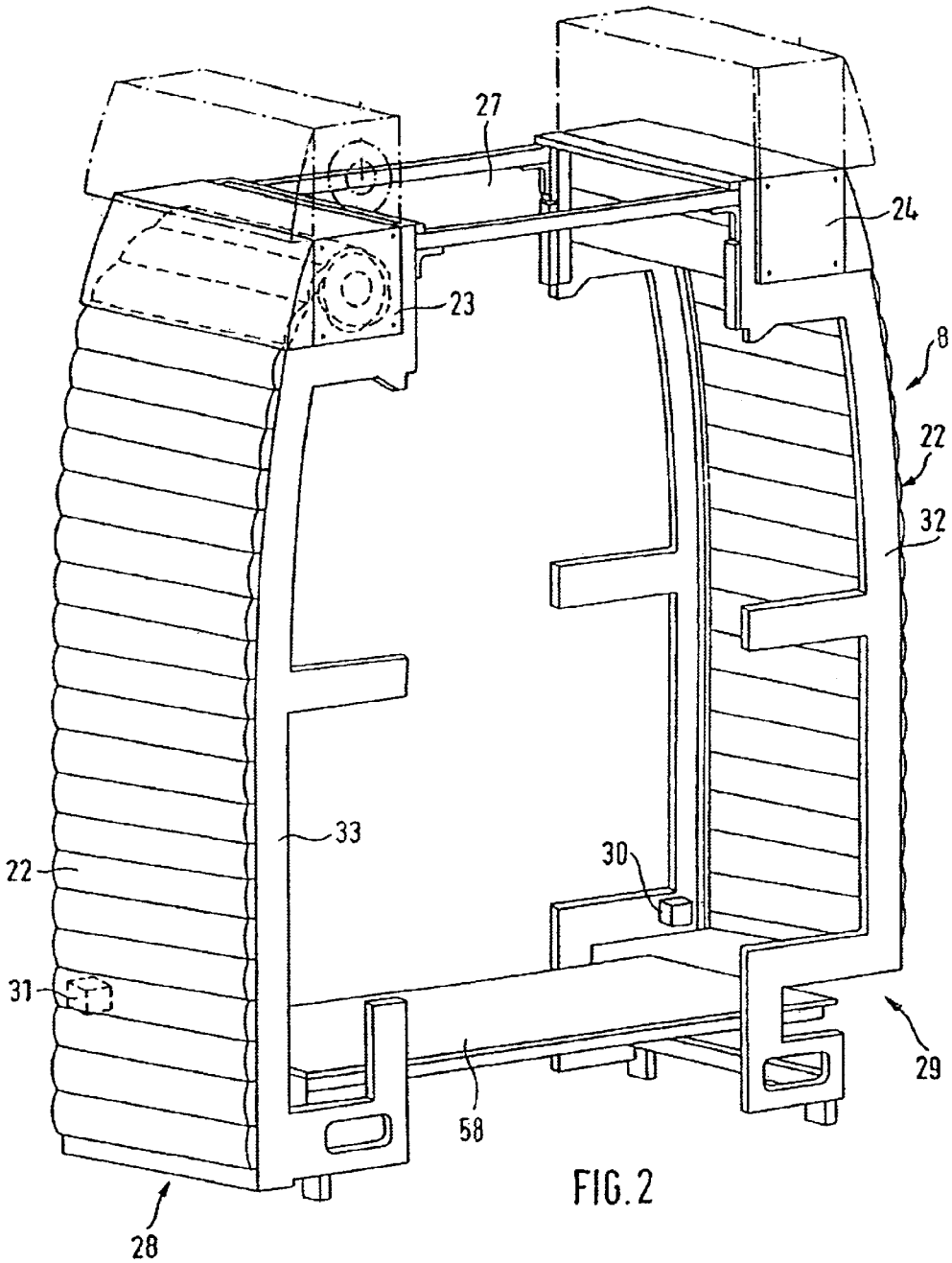
FIG. 2 is a perspective view of access module which may be provided according to the invention between the printing units and other parts of the machine.

Between the printing units 2, 3, 4 and 5 covered according to the invention are access modules 8, 9, 10, the make-up of which may be gathered in detail from FIG. 2. A further access module 11, can be seen, behind the last printing unit 5, in front of a two-part or two-door dryer 12. Furthermore, a print access module 14, if appropriate likewise with two covers, is located behind the cooling unit 13. Finally, FIG. 1 shows, on the right, a print-carrier or printed-copy discharge device in the form of a cross cutter 15 with corresponding folding means, behind which the cut and, if appropriate, folded printed copies are laid onto a discharge device 25 or onto a belt. As stated, the invention may also be employed successfully for other rotary printing machines, and the make-up and number of the individual components may also differ from FIG. 1.

A further feature of the invention is that the operating side, shown in FIG. 1, of the printing machine is fully covered, so that admittance or access into the interior of the individual components, in particular the printing units, is prevented. As stated, the same cover elements, that is to say doors and roller blinds, may be used on the front side, that is to say on the operating side illustrated in FIG. 1, as on the rear side, not illustrated, the so-called driving side of the rotary printing machine 1. A further advantage of the invention is that, the switch cabinets 63 are spaced from the printing machine 1 in FIG. 1, so that operators can walk back and forth between the printing machine 1 and the switch cabinets 63.

The topsides 16, 17, 18, 19 of the printing units 2, 3, 4, 5, may be in the form of a cover with air outlet apertures. Alternatively, or the topside of the printing units 2 to 5 and also, if appropriate, the access modules and even the remaining parts illustrated may be completely open, so that the air flowing in underneath the lateral covers or from below can escape on the topside. For example, the covers (doors, roller blinds), which are described in more detail below, may be at a distance of about 10 to 50 mm from the floor, so that sufficient air can flow in.

As see in FIG. 1, the printing units 2, 3, 4, 5 are each provided laterally with doors 20, 21 which can swing open forwards. These doors 20, 21 are curved two-dimensionally, as already described, while the covers 22 of all the access modules, in particular the access modules 8, 9, 10 between the printing units 2 to 5, are curved only one-dimensionally, as is evident from FIG. 1. The control of the rotary printing machine 1 in the form of a stationary or portable control desk 55 is indicated diagrammatically in FIG. 1A. Between the printing machine 1 and the operator desk 55 there are corresponding communication lines 56, 57 permanently wired or by radio or in a similar way. Information is transmitted by the operating desk 55 to the individual components on the printing machine 1 via lines 56 and, information arrives from the individual components, for example from the safety switches or monitoring elements, such as sensors, etc., at the operating desk via lines 57. The desk may also contain the control apparatus, usually in the form of one or a number of computers.

FIG. 2 illustrates a particular embodiment of a print access module 8. This comprises, in the upper parts, winding rollers 23, 24 which can be raised, as indicated by the arrows. However, it may be sufficient, for example, to design only the roller 23 so as to be raisable, thus resulting, from the operating side (FIG. 1), in an increased access area, so that even tall persons can enter. The access area can also be covered on the opposite side by wind-up roller blinds 22 when the machine is in operation, during the wind-up, that is to say during the rotation of the rollers 23, 24 the roller blind is wound on the latter. Roller blinds may be used on both sides of the access module illustrated in FIG. 2 and are guided laterally, for example in slots or rails, in a similar way to conventional windows. Air entering from lower region 29, after heating can escape from the upper region 27 of the access module 8 when the latter is open, or, in the case of a cover, through opening in the cover.

The access module 8 includes a stand 28 having on both sides, as seen in the longitudinal direction of the printing machine 1, connecting surfaces 32, 33, via which it can be connected to the adjacent printing units 2 to 5, so that a gapless covering of the interspaces is afforded, in order to prevent access or admittance into the interior of the printing units 2 to 5 or of the machine when the access modules are in the closed state. A safety switch 31 is preferably capable of being operated only from outside, or a switch 30 may be mounted inside the machine, whereby, in the case of actuation, closing of the cover 22 can be carried out only after an appropriate time delay of about 5 seconds. It is advantageous to provide, for example, a 300 mm high standing platform 58, 50 that it is possible to work comfortably inside the machine, on the printing units 2 to 5, when the machine is at a standstill.

Figure 4:
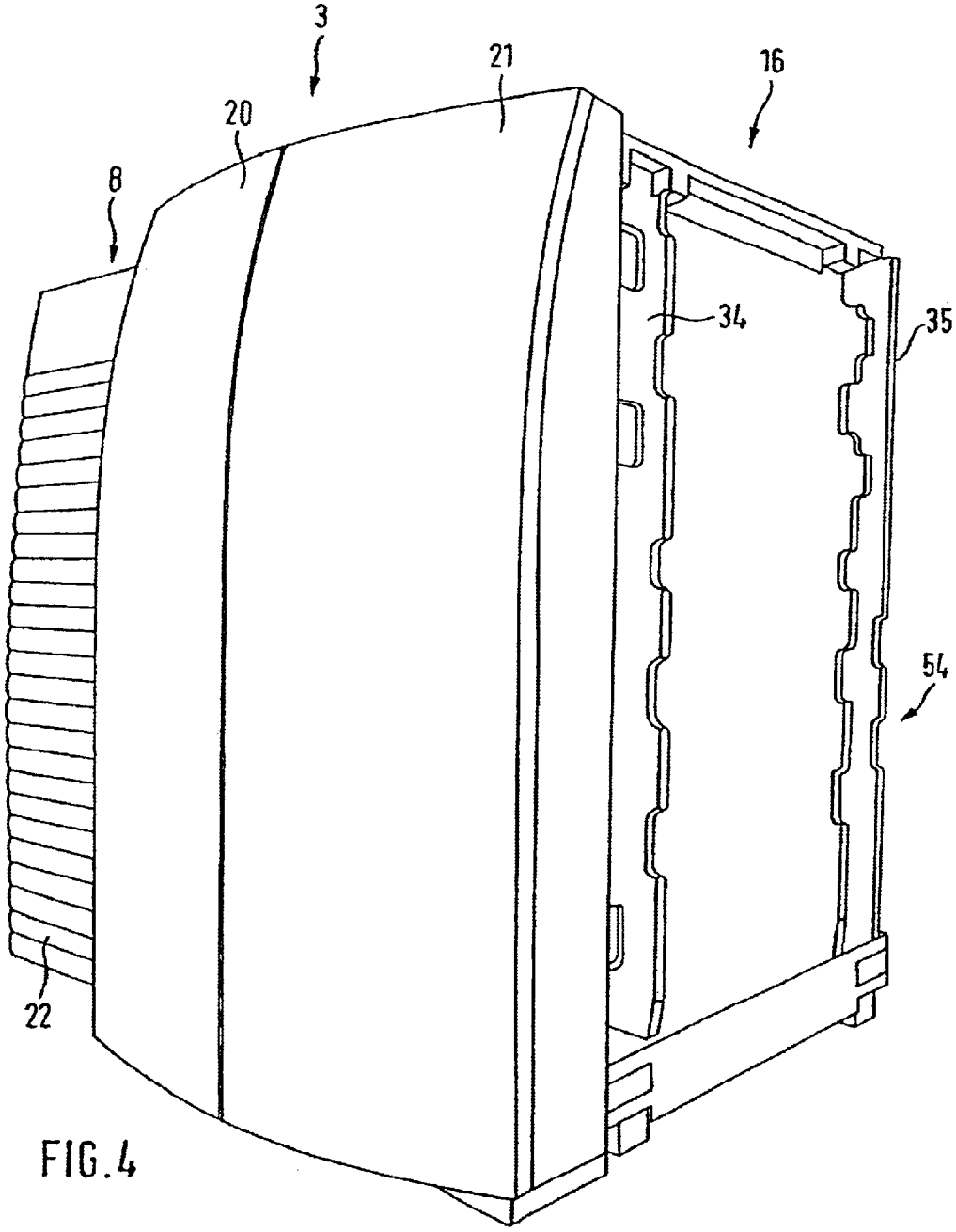
FIG. 4 shows the cover according to the invention of a printing unit and of an access module in a perspective view.

The cover of the access module 8 in FIGS. 1 and 2 can also be seen in FIG. 4, this also applying to the cover of the printing unit 3. The access module 9 can be attached to the lateral connecting region 35, that is to say is connectable to the stand 54 of the printing unit 3.

Referring to FIG. 4, a side wall 34 of the printing unit 3 is located behind the cover 20 and 21.

Figure 3:
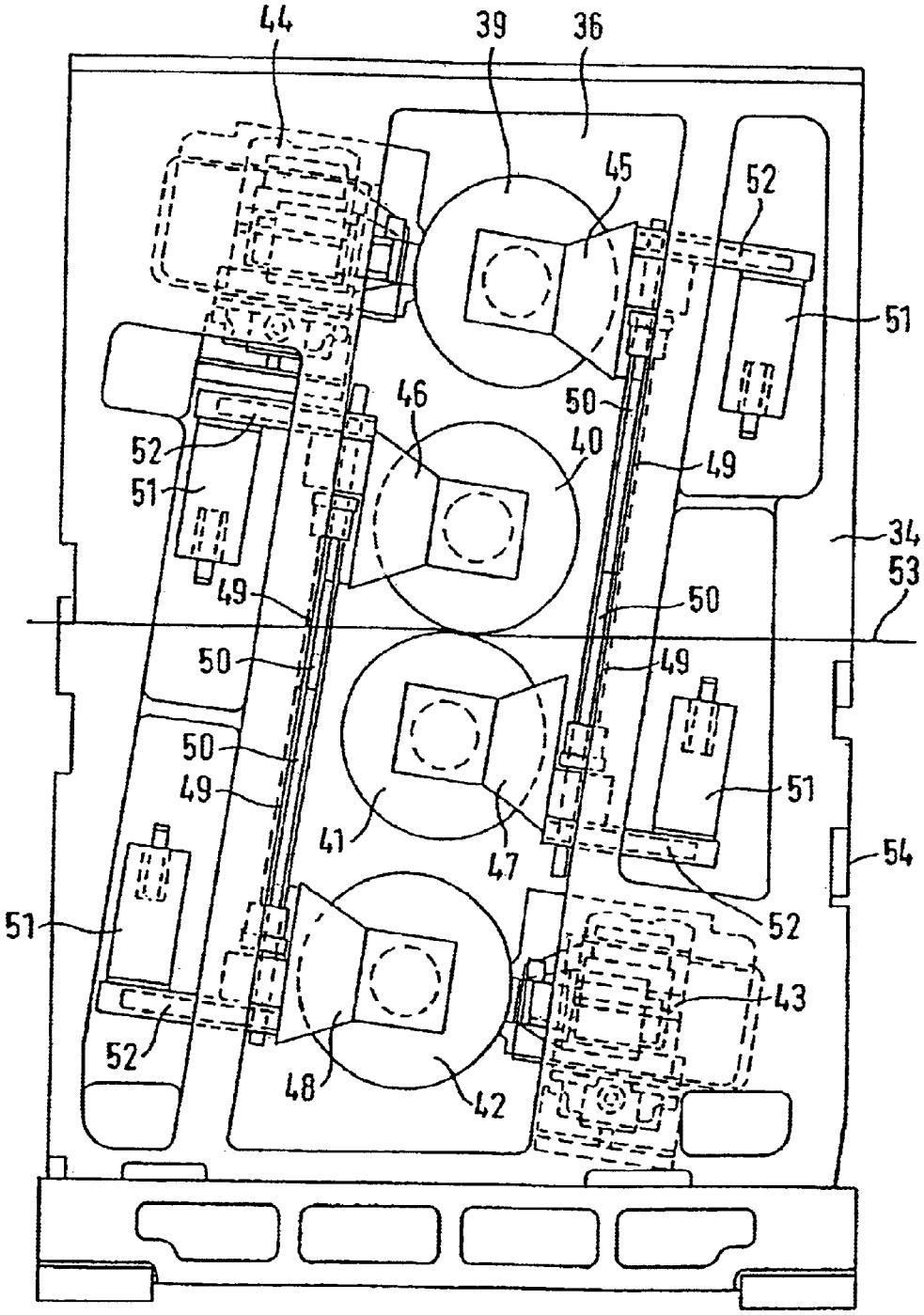
FIG. 3 shows a side view of a novel printing-unit side wall which is covered according to the invention.

Referring to FIG. 3, the side wall 34 has an obliquely arranged aperture 36, through which sleeve-shaped printing formes to be imaged in the printing machine or already imaged outside it can be pushed. The same also applies to sleeve-shaped rubber blankets, that is to say rubber sleeves. The sleeve-shaped or else finite, for example rolled-up printing plates are pushed onto plate cylinders 39, 42 and the sleeve-shaped rubber blankets, that is to say rubber sleeves, are pushed onto rubber-blanket cylinders 40 and 41.

Preferably, the cylinders 39 to 42 lie on an oblique straight line. As already stated, the novel printing units according to FIG. 3, which can be covered by covers according to the invention, may be provided with different cylinder diameters, that is to say with cylinders 39 to 42 of different size, so that different formats can be processed. When the imaging of the printing forms, for example sleeves, is carried out in the machine, imaging devices must be provided, for example controllable lasers, by means of which the printing image is applied in a known way, for example by the thermotransfer method, to the plate cylinders 39, 42 or sleeve arranged on these. These lasers 43, 44 are arranged laterally of the cylinders 39 to 42. It is also possible for the lasers 43, 44 to be arranged above or in an arrangement rotated through ninety degrees, so that the laser beam impinges approximately horizontally onto the respective plate cylinders 39 and 42.

The cylinders 39, 40, 41, 42 are in each case guided via mountings 45, 46, 47, 48 on one of the oblique walls of the aperture 36 on linear guides 49, for example rail. The cylinders 39 to 42 by means of spindles 50 according to the cylinder diameter used, for throw-on and throw-off purposes for imaging, that is to say for moving up to the laser station 43, 44, by driving the spindles 50 by means of electric motors 51, for example via drive belts 52, so that each of the cylinders 39 to 42 can be moved individually.

By means of the arrangement of the printing-unit cylinders 39 to 42 illustrated diagrammatically in FIG. 3, a web guided approximately horizontally through the printing unit 3 can be printed on both sides with a colour by the rubber-blanket cylinders 40, 41. The print-carrier web 53 is guided between the two cylinders 40, 42. The printing-unit stand 54 is also shown in FIG. 4.

For safety reasons it is preferable if the safety switches 30, 31 are arranged in the access module 8 (FIG. 2). However it is also possible to have an arrangement of switches 59 to 62 on the doors 20 or 21 of the printing units 2 to 5, as shown in FIG. 1. The essential factor is that the operator must stand outside the machine in order to actuate one of the switches 59 to 62. Alternatively, the switches may also be arranged at other locations in the vicinity of the printing machine 1 which satisfy this precondition.

According to the present invention, all the safety switches are to be actuated before the machine can be put into operation from the central control desk 55. When repair or maintenance work is to be carried out, with the machine at a standstill, all the covers 20, 21, 22 and also covers on the dryer and on the cooling unit and also on the cross cutter can, as already explained, be opened jointly, that is to say centrally, or partially, according to the corresponding need.

The principle on which the invention is based is, therefore, to keep the rotary printing machine accessible on both sides but to offer no possibility of admittance, during operation and/or during imaging or resetting so that virtually absolute protection is afforded. There is further protection in that covers, at least the covers 20, 21, 22, consist of a material which is impermeable to laser beams or at least damps laser beams, so that the operating personnel is additionally protected, should a fault occur in the lasers 43, 44 which are protected in any case. This affords virtually double the protection.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A rotary printing machine comprising a print carrier supply device;

at least one printing unit, said printing unit having an interior where printing operations are performed;

a print carrier discharge device; and an access module provided between the at least one printing unit and each of the print carrier supply device and the print carrier discharge device, said access modules each comprising a stand having a pair of opposed apertures which can be covered to block access to the interior of the printing unit from either side of the printing machine during printing, each said stand having opposed sides which can be connected to respective ones of said supply device, said discharge device, and said printing unit.

2. The rotary printing machine according to claim 1 comprising a plurality of said printing units arranged one behind the other, one of said access modules being located between each adjacent pair of said printing units.

3. The rotary printing unit according to claim 1 further comprising an imaging device in at least one of said printing units, said access modules blocking access to the interior of the printing machine during imaging.

4. The rotary printing machine according to claim 1 wherein, during operation, opening of the access modules for the purpose of obtaining access into the printing-unit interior is blocked from one of the printing units and the access modules and a central control desk.

5. The rotary printing machine according to claim 1 further comprising a safety switch assigned to each said access module, wherein none of said safety switches can be reached by a person located in the access module, and all the safety switches have to be actuated before the rotary printing machine can be operated.

6. The rotary printing machine according to claim 1 further comprising a safety switch assigned to each said access module, wherein each said safety switch is located inside a respective said module and brings about delayed closing, and all the safety switches have to be actuated before the rotary printing machine can be operated.

7. The rotary printing machine according to claim 1 wherein each said access module has a pair of covers over said opposed apertures and, when the machine is at a standstill, all the covers can be opened centrally from a control desk, wherein each said cover can be pulled upwards in the manner of a roller blind into a roller-blind box.

8. The rotary printing machine according to claim 7 wherein one of the roller-blind boxes can be raised, so that a larger vertical access is afforded, and wherein a standing platform is provided in on the underside of each said access module.

9. The rotary printing machine according to claim 1 wherein each said printing unit is covered on both sides, by two doors on each side, so that there is no possibility of access on either side of the printing units during operation, the printing-unit having a topside provided with means for releasing air.

10. The rotary printing machine according to claim 1 wherein said print carrier supply device comprises a reel changer and said print carrier discharge device comprises a dryer including a cooling unit, said machine further comprising a cutting unit and an access module between said dryer and said cutting unit, said devices and said modules being covered without gaps on both sides of the machine in such a way that there is no possibility of access into the interior of the rotary printing machine on either side of the rotary printing machine.

11. The rotary printing machine according to claim 10 further comprising a control desk for generating central commands to all parts of the rotary printing machine for servicing or maintenance purposes, including commands for selectively releasing at least some of said covers for the purpose of obtaining access into the machine interior.

12. The rotary printing machine according to claim 1 further comprising lasers in each of said printing units for imaging printing rollers with laser beams;

covers arranged on both sides of each said printing unit; and covers on both sides of each said access modules, said covers comprising a material which at least damps said laser beams.

13. The rotary printing machine according to claim 1 comprising doors on the printing units and roller blinds on said access modules, said roller blinds being movable by one of electric motors and pneumatic devices which can activated from a control desk.

14. The rotary printing machine according to claim 1 further comprising switch cabinets arranged on one side of the printing machine at a distance from the printing machine, so that an operator can walk between said switch cabinets and said rotary machine.

15. The rotary printing machine according to one claim 1 wherein each said printing unit has a pair of plate cylinders, a pair of rubber blanket cylinders, and a side wall with an aperture with oblique sides, through which sleeves or printing plates to be imaged or sleeves or printing plates already imaged outside the printing machines can be pushed through the side wall onto the cylinders.

16. The rotary printing machine according to claim 15 wherein the rubber-blanket cylinders assigned to the plate cylinders are likewise equipped with sleeves which can be pushed on through the aperture.

17. The rotary printing machine according to claim 15 wherein the printing units comprise printing-unit cylinders having different diameters, which cylinders are held displaceably on rails via mounting on the oblique sides of the aperture and can be displaced by means of spindle driven by motors according to the diameters of the cylinders present in the machine, for throw-on and throw-off purposes and for imaging by means of laser devices.

18. The rotary printing machine according to claim 1 further comprising laser devices arranged adjacent to the plate cylinders for imaging the printing forms.

19. The rotary printing machine according to claim 1 wherein the printing machine has a degree of automation which does not require manipulations during the printing operation.

* * * * *